US012085331B2

(12) United States Patent
Li et al.

(10) Patent No.: US 12,085,331 B2
(45) Date of Patent: Sep. 10, 2024

(54) SHELF TRAY ASSEMBLY AND REFRIGERATION APPLIANCE

(71) Applicant: BSH Hausgeraete GmbH, Munich (DE)

(72) Inventors: Ertao Li, Nanjing (CN); Jiajun Li, Nanjing (CN); Ting Yi, Nanjing (CN); Min Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 297 days.

(21) Appl. No.: 17/705,576

(22) Filed: Mar. 28, 2022

(65) Prior Publication Data

US 2022/0307762 A1 Sep. 29, 2022

(30) Foreign Application Priority Data

Mar. 29, 2021 (CN) ..... 202120626793.3

(51) Int. Cl.
*F25D 25/02* (2006.01)

(52) U.S. Cl.
CPC ..... *F25D 25/02* (2013.01)

(58) Field of Classification Search
CPC .. F25D 25/02; F25D 2325/021; F25D 25/024; F25D 2325/022; A47B 96/025; A47B 2210/175; A47B 96/062; A47B 96/027
See application file for complete search history.

(56) References Cited

U.S. PATENT DOCUMENTS 3,859,932 A * 1/1975 Armstrong ..... A47B 96/025 312/246
8,403,438 B2 * 3/2013 Park ..... F25D 25/02 108/143
8,840,205 B2 * 9/2014 Chellappan ..... F25D 23/067 108/93
9,033,438 B2 * 5/2015 Kelly ..... F25D 25/024 108/86
9,335,089 B1 * 5/2016 Gossens ..... A47B 96/025
(Continued)

FOREIGN PATENT DOCUMENTS

CN 106766627 A * 5/2017
DE 102009046027 A1 * 5/2011 ..... F25D 23/067
(Continued)

*Primary Examiner* — Hiwot E Tefera
(74) *Attorney, Agent, or Firm* — Laurence A. Greenberg; Werner H. Stemer; Ralph E. Locher

(57) ABSTRACT

A shelf tray assembly has a bracket and a partition, where the partition includes a first partition. The bracket includes a sliding rail with a second section and a first section higher than the second section, and there is a first height difference between the first and second sections. The first partition is configured to reciprocate on the bracket along the sliding rail, and a movement path of the first partition includes a first position and a second position. When the first partition is located at the first position, the first partition is supported on the first section. When the first partition is located at the second position, the first partition is supported on the second section. The shelf tray assembly includes a lifting structure. A height difference when the first partition rises or falls can be effectively reduced, and a moving process of the first partition becomes smoother.

13 Claims, 4 Drawing Sheets

(56) References Cited

U.S. PATENT DOCUMENTS

| | | | | |
|---|---|---|---|---|
| 10,935,305 | B1 * | 3/2021 | Bassler | F25D 25/02 |
| 2010/0109498 | A1 * | 5/2010 | Ramm | F25D 23/067 312/408 |
| 2011/0001415 | A1 | 1/2011 | Park et al. | |
| 2012/0091084 | A1 * | 4/2012 | Amaral | F25D 25/024 211/80 |
| 2020/0263920 | A1 * | 8/2020 | Brzezina | F25D 25/024 |
| 2021/0102750 | A1 * | 4/2021 | Voltarelli | F25D 25/025 |
| 2022/0018594 | A1 * | 1/2022 | Wantland | A47B 96/025 |

FOREIGN PATENT DOCUMENTS

| | | | | |
|---|---|---|---|---|
| DE | 102012221801 | A1 * | 5/2014 | F25D 25/02 |
| DE | 102021207031 | A1 * | 1/2023 | |
| JP | 2002090054 | A | 3/2002 | |
| KR | 100431346 | B1 | 5/2004 | |
| KR | 20130037117 | A * | 4/2013 | F25D 25/027 |

* cited by examiner

SHELF TRAY ASSEMBLY AND REFRIGERATION APPLIANCE

CROSS-REFERENCE TO RELATED APPLICATION

This application claims the priority, under 35 U.S.C. § 119, of Chinese Patent Application CN 202120626793.3, filed Mar. 29, 2021; the prior application is herewith incorporated by reference in its entirety.

FIELD AND BACKGROUND OF THE INVENTION

This application relates to the technical field of household appliances, and in particular, to a shelf tray assembly and a refrigeration appliance having the same.

In existing refrigeration appliances, to improve the space utilization of a storage cavity, a shelf tray assembly is often disposed in the storage cavity to divide the storage cavity into a plurality of small spaces. Further, to meet the requirement of placing a large-size object, a foldable shelf tray assembly is derived, which divides a partition of the shelf tray assembly into a front partition and a rear partition. The front partition can be pulled out to the front of the rear partition at a height equivalent to the rear partition. The front partition can also be pushed to the rear and hidden below the rear partition, which requires an inclined sliding rail for implementation. The manner can meet the storage requirement of a large-size object. To achieve such a movement, the shelf tray assembly needs to occupy as little space as possible in an accommodating cavity, and the sliding rail has to be set very steep. In this case, the front partition is pulled with greater resistance and obvious friction, causing a poor user experience.

SUMMARY OF THE INVENTION

A first aspect of embodiments of the invention is to provide an improved shelf tray assembly, which can enhance the smoothness of the partition when being pulled or pushed in.

A shelf tray assembly is provided, including a bracket and a partition, where the partition includes a first partition. The bracket includes a sliding rail, the sliding rail includes a second section and a first section higher than the second section, and there is a first height difference between the first section and the second section. The first partition is configured to reciprocate on the bracket along the sliding rail, and a movement path of the first partition includes a first position and a second position. When the first partition is located at the first position, the first partition is at least partially supported on the first section. When the first partition is located at the second position, the first partition is at least partially supported on the second section. The shelf tray assembly further includes a lifting structure, and the lifting structure is configured to lift the first partition, so that a rising height of the first partition moving from the second position to the first position is less than the first height difference.

The lifting structure includes a first protrusion, and the first protrusion is arranged on the first partition and protrudes toward the sliding rail; and when the first partition is located at the second position, the first protrusion is supported on the second section. When the first partition is located at the first position, a lower end of the first protrusion is lower than a height of the first section.

When the first partition is located at the first position, the first protrusion is suspended so that the lower end of the first protrusion is lower than the height of the first section.

The first partition further includes a support portion higher than the first protrusion, and the support portion extends toward both sides. When the first partition is located at the first position, the support portion is supported on the first section. When the first partition is located at the second position, the support portion is suspended.

The lifting structure further includes a second protrusion located at a front end of the first partition and a second groove located at a front end of the first section, and the second protrusion protrudes toward the sliding rail; and when the first partition is located at the first position, the second protrusion is located at the second groove.

The lifting structure includes a third groove located at a rear end of the first section, and when the first partition is located at the first position, the support portion is located in the third groove.

The shelf tray assembly further includes a first groove located at a rear end of the second section, where the first groove cooperates with the first protrusion to limit backward movement of the first partition, and/or the second groove cooperates with the second protrusion to limit forward movement of the first partition, and/or the third groove cooperates with the support portion to limit the forward movement of the first partition.

The first groove and the sliding rail are connected by an inclined surface.

The sliding rail further includes a guide inclined surface inclined downward from front to rear, and the guide inclined surface connects the first section and the second section.

The guide inclined surface includes a first guide inclined surface and a second guide inclined surface, and the first guide inclined surface is located in front of the second guide inclined surface. The first guide inclined surface is configured for the second protrusion to slide, and the second guide inclined surface is configured for the support portion to slide.

A slope of the first guide inclined surface is less than that of the second guide inclined surface.

The shelf tray assembly further includes a first boss located at a front end of the bracket and protruding inward relative to a side wall of the bracket, where a rearward-facing side wall surface of the first boss is inclined downward from front to rear to form at least a part of the second guide inclined surface.

The shelf tray assembly further includes a second boss located at a front end of the first boss and protruding inward relative to the first boss, where a rearward-facing side wall surface of the second boss is inclined downward from front to rear to form at least a part of the first guide inclined surface.

The partition further includes a second partition, and the second partition is located at a rear end of the bracket. When the first partition is located at the first position, the first partition is located in front of the second partition. When the first partition is located at the second position, the first partition is located below the second partition.

A second aspect of the embodiments of the invention is to provide a refrigeration appliance, and the refrigeration appliance including a shelf tray assembly provides a better user experience.

The refrigeration appliance includes a storage cavity, and further includes any shelf tray assembly described above, and a bracket is connected to a cavity wall of the storage cavity to mount the shelf tray assembly to the storage cavity.

Other features which are considered as characteristic for the invention are set forth in the appended claims.

Although the invention is illustrated and described herein as embodied in a shelf tray assembly and a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The following clearly and completely describes the technical solutions of this application with reference to specific embodiments. Apparently, the described embodiments are some rather than all of the embodiments of this application. All other embodiments obtained by a person of ordinary skill in the art based on the embodiments of this application without creative efforts shall fall within the protection scope of this application.

Figure 1:
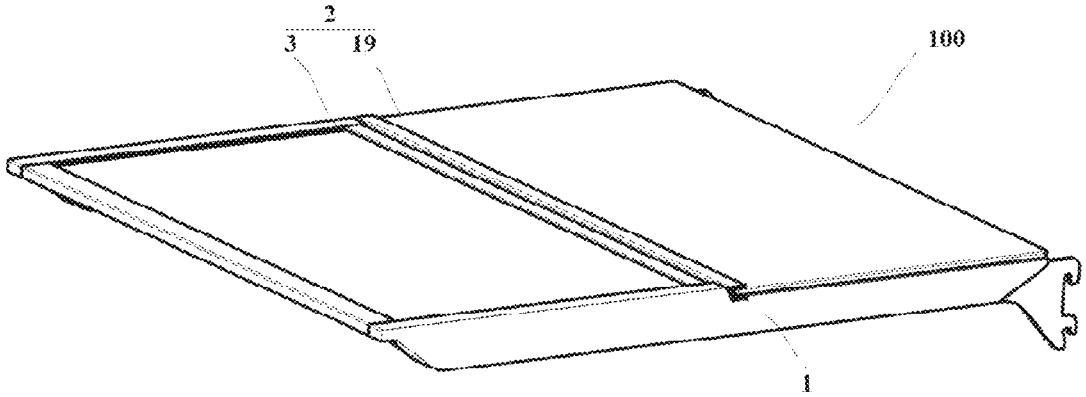
FIG. 1 is a diagrammatic, perspective view of a shelf tray assembly according to an embodiment of the invention, where a first partition is located at a first position.

Referring now to the figures of the drawings in detail and first, particularly to FIG. 1 thereof, there is shown an embodiment of the invention, namely a shelf tray assembly 100, and the shelf tray assembly 100 includes a bracket 1 and a partition 2. The shelf tray assembly 100 may be applied to household appliances, especially household appliances having a storage cavity 201, so as to divide the storage cavity 201 into a plurality of small storage spaces.

Figure 2:
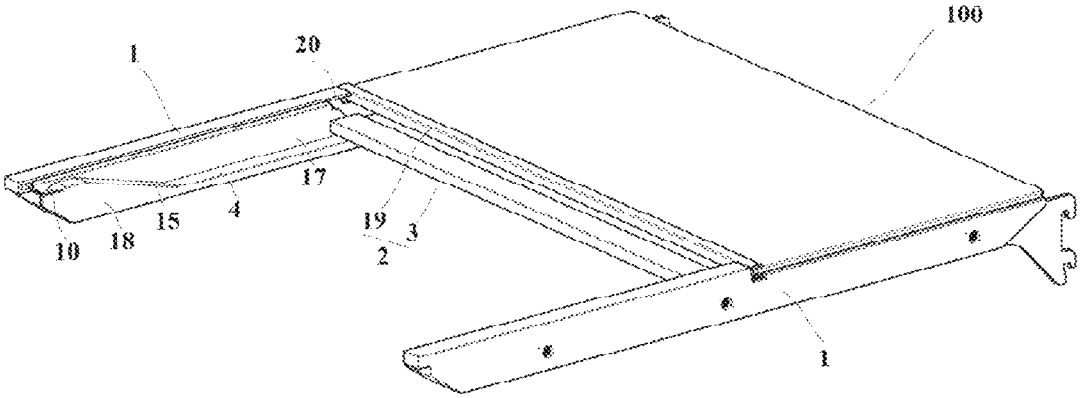
FIG. 2 is a perspective view of the shelf tray assembly according to an embodiment of the invention, where a first partition is located at a second position.

As shown in FIG. 1 and FIG. 2, the partition 2 includes a first partition 3 and a second partition 19, the bracket 1 includes a sliding rail 4, the second partition 19 is connected to a rear end of the bracket 1, and the first partition 3 can slide on the sliding rail 4 of the bracket 1.

A movement path of the first partition 3 includes a first position and a second position.

As shown in FIG. 1, the first partition 3 is located at the first position. In this case, the first partition 3 is located at a front end of the bracket 1, and a height of the first partition 3 is equivalent to that of the second partition 19. As shown in FIG. 2, the first partition 3 is located at the second position. In this case, the first partition 3 is located at a rear end of the bracket 1, and the first partition 3 is located below the second partition 19.

Figure 3:
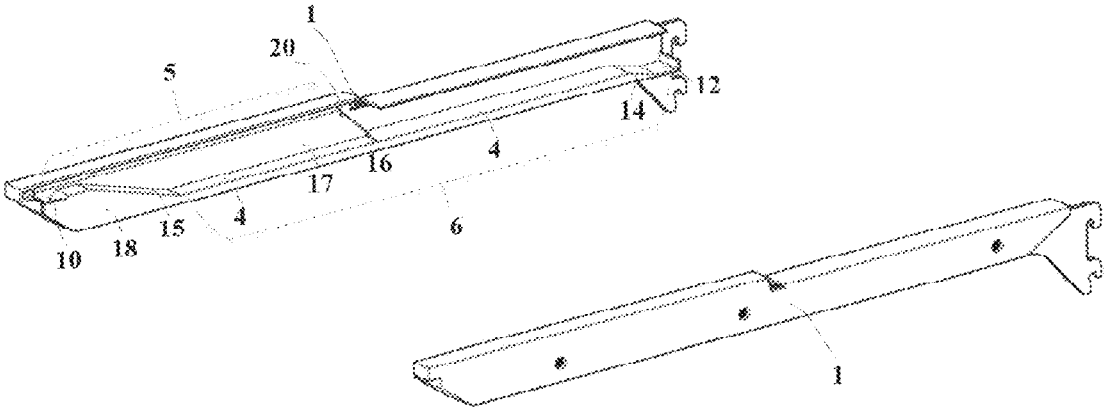
FIG. 3 is a perspective view of a bracket in the shelf tray assembly according to an embodiment of the invention.
Figure 4:
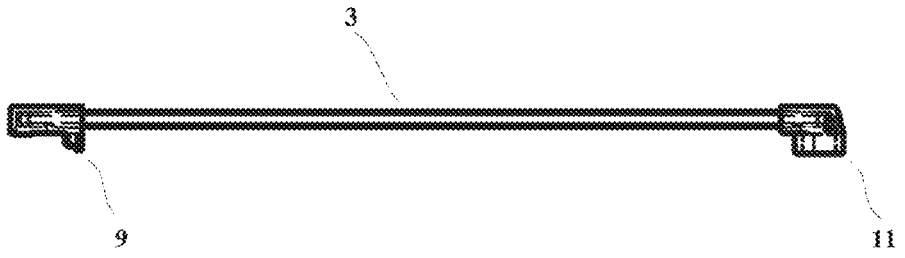
FIG. 4 is a cross-sectional view of the first partition in the shelf tray assembly according to an embodiment of the invention.

Referring to FIG. 2 and FIG. 3, the sliding rail 4 includes a first section 5 and a second section 6, and a height of the first section 5 is higher than that of the second section 6. When the first partition 3 is located at the first position, the first partition 3 is supported on the first section 5; and when the first partition 3 is located at the second position, the first partition 3 is supported on the second section 6. It can be understood that the "supported" herein may be that the first partition 3 is fully supported on the first section 5 or the second section 6, or may be locally or partially supported on the first section 5 or the second section 6.

The shelf tray assembly 100 further includes a lifting structure, which can make a rising height of the first partition 3 moving from the second position to the first position less than a height difference between the first section 5 and the second section 6.

In this way, the first partition 3 can move between the first position and the second position more smoothly with less friction, providing a better user experience.

Referring to FIGS. 2 to 7, the lifting structure may include a first protrusion 11.

In a possible implementation, the first protrusion 11 is located on the first partition 3 and protrudes toward a direction of the sliding rail 4.

When the first partition 3 is located at the second position, a lower end of the first protrusion 11 is supported on the second section 6, so that a height of the first partition 3 is lifted. When the first partition 3 is located at the first position, the lower end of the first protrusion 11 is lower than a height of the first section 5.

In a solution without a lifting structure, it can be understood that, a rising height of the first partition moving from the second section 6 to the first section 5 is the same as a height difference between the first section 5 and the second section 6. However, in this embodiment, the rising height of the first partition moving from the second section 6 to the first section 5 is less than the height difference between the first section 5 and the second section 6. For example, if a height of a support portion 21 in contact with the first section 5 is consistent with that in the solution without a lifting structure, the rising height of the first partition moving from the second section 6 to the first section 5 is at least less than a height value of the first protrusion 11 compared to the foregoing height difference. A person skilled in the art can immediately adjust the height of the support portion 21 as required, and the objective of this embodiment can still be achieved.

In a possible implementation, when the first partition 3 is located at the second position, the lower end of the first protrusion 11 is supported on the second section 6; and when the first partition 3 is located at the first position, the first protrusion 11 is suspended. It is worth noting that the "suspended" herein may be a case in which the first protrusion 11 is not supported on the first section 5, or may be supported on a surface with a height lower than the height of the first section 5.

Figure 8:
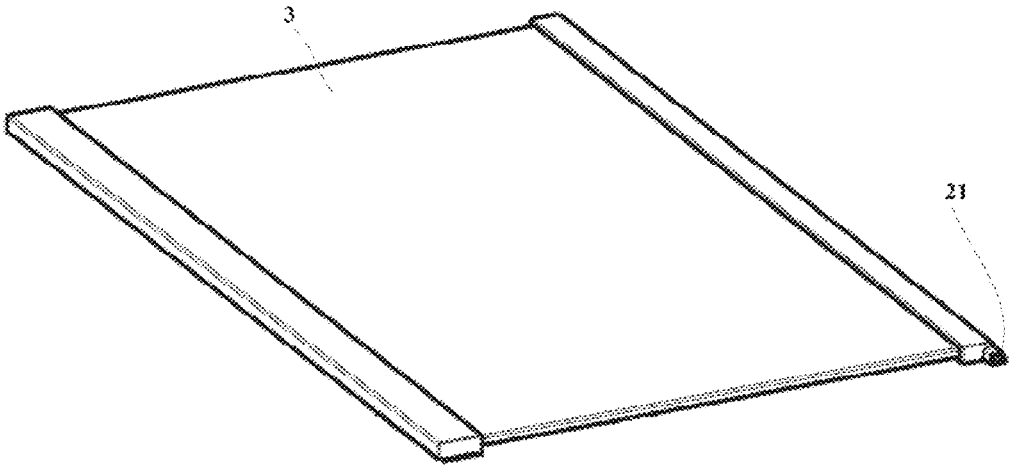
FIG. 8 is a perspective view of the first partition according to an embodiment of the invention.

In a possible implementation, referring to FIG. 8, the shelf tray assembly further includes a support portion 21, and the support portion 21 is configured to support the first section 5 when the first partition 3 is located at the first position. A specific implementation is that the support portion 21 is located on the first partition 3 and extends toward both sides, and a height of the support portion 21 is higher than that of the lower end of the first protrusion 11. In this case, a height value that can be lowered is a distance between the lower end of the first protrusion 11 and the height of the support portion 21.

The lifting structure may further include a second groove 10 located at a front end of the first section 5, and a second protrusion 9 located at a front end of the first partition 3. When the first partition 3 is located at the first position, the second protrusion 9 is located in the second groove 10. In this way, the foregoing objective can be further achieved, and contact points are increased, so that the first partition 3 becomes more stable.

The lifting structure may further include a third groove 20 located at a rear end of the first section 55. When the first partition 3 is located at the first position, the support portion 21 is located in the third groove 20.

In a possible implementation, the first partition 3 is pushed to the second position from front to rear. A first groove 12 is provided at a rear end of the second section 6. When the first partition 3 is located at the second position, the first protrusion 11 located at a rear end of the first partition 3 is at least partially located in the first groove 12. In this way, backward movement of the first partition 3 can be limited to some extent, so that a case in which the first partition 3 moves backward excessively and hits a rear wall of the storage cavity 201 is effectively reduced.

Further, the first groove 12 is disposed at the rear end of the second section 6, rather than a front end or a middle of the second section 6, which can reduce the friction when the first protrusion 11 slides through the first groove 12, so that the first partition 3 moves more smoothly.

Preferably, a transition section between the first groove 12 and the sliding rail 4 is connected with an inclined surface 14, which can further reduce the friction during movement of a first plate, so that the first partition 3 moves more smoothly.

In a possible implementation, the first partition 3 is pushed to the first position from rear to front. In this case, when the support portion 21 is located in the third groove 20, forward movement of the first partition 3 can be limited. When the second protrusion 9 is located in the second groove 10, the forward movement of the first partition 3 can be limited. Therefore, the probability that the first partition 3 moves forward excessively to detach from the sliding rail 4 is reduced.

Referring to FIG. 2 to FIG. 8, in a possible implementation, the sliding rail 4 further includes a guide inclined surface. The first partition 3 slides from the first section 5 to the second section 6 and from the second section 6 to the first section 5 along the guide inclined surface. As shown in the figures, the guide inclined surface connects the first section 5 and the second section 6.

The guide inclined surface may further include a first guide inclined surface 15 and a second guide inclined surface 16. Relative to an extension direction of the bracket 1, the first guide inclined surface 15 is located in front of the second guide inclined surface 16.

In a possible implementation, the second protrusion 9 of the first partition 3 may slide from the second section 6 to the first section 5 along the first guide inclined surface 15, or may slide from the first section 5 to the second section 6 along the first guide inclined surface 15.

In a possible implementation, the support portion 21 of the first partition 3 may slide from the second section 6 to the first section 5 along the second guide inclined surface 16, or may slide from the first section 5 to the second section 6 along the first guide inclined surface 15.

In a possible implementation, a third groove 20 is provided at a junction of the first section 5 and the second guide inclined surface 16.

In this way, the movement path of the first partition 3 is shorter whether moving from the first position to the second position, or from the second position to the first position, which is more convenient for use.

In a possible implementation, a slope of the first guide inclined surface 15 is less than that of the second guide inclined surface 16. It can be understood that a force point is closer to the front end of the first partition 3 whether a user pulls out the first partition 3 or pushes in the first partition 3. The inclination rate of the first guide inclined surface 15 is set to be less than that of the second guide inclined surface 16, so that a moving process of the first partition 3 becomes smoother, and the friction is reduced.

In a possible implementation, referring to FIG. 3, a first boss 17 is disposed at a front end in an inner side of the bracket 1, a rearward-facing side wall surface of the first boss 17 is inclined downward from front to rear and connects the first section 5 and the second section 6, and the first boss 17 can be used as the second guide inclined surface 16 or a part of the second guide inclined surface 16.

Still referring to FIG. 3, in a possible implementation, a second boss 18 is disposed in an inner side of a front end of the first boss 17, a rearward-facing side wall surface of the second boss 18 is inclined downward from front to rear and connects the first section 5 and the second section 6, and the second boss 18 can be used as the first guide inclined surface 15 or a part of the first guide inclined surface 15.

From the foregoing text description and/or accompanying drawings, it can be learned that the first guide inclined surface 15 is more inward than the second guide inclined surface 16. To successfully implement the foregoing moving process of the first partition 3, some improvement can be made to the first boss 17 and/or the support portion 21. For example, the support portion 21 is larger or located more outside so that the support portion 21 can slide on the second guide inclined surface 16; and the second protrusion 9 has a relatively small size or has a location closer to inside so that the second protrusion 9 can slide on the first guide inclined surface 15.

Figure 5:
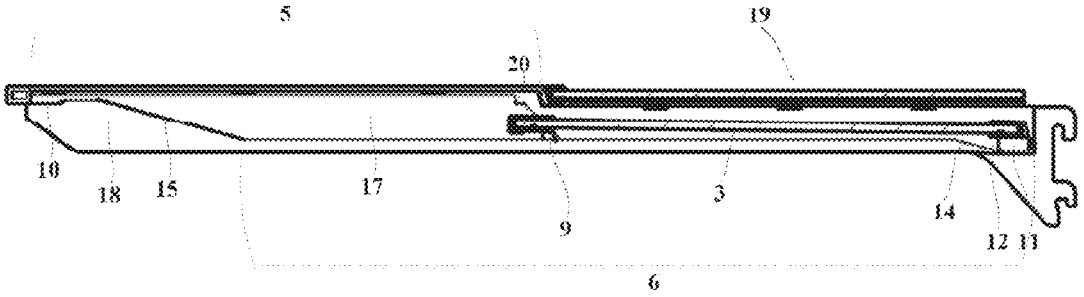
FIG. 5 is a cross-sectional view of the shelf tray assembly according to an embodiment of the invention, where the first partition is located at a second position.
Figure 6:
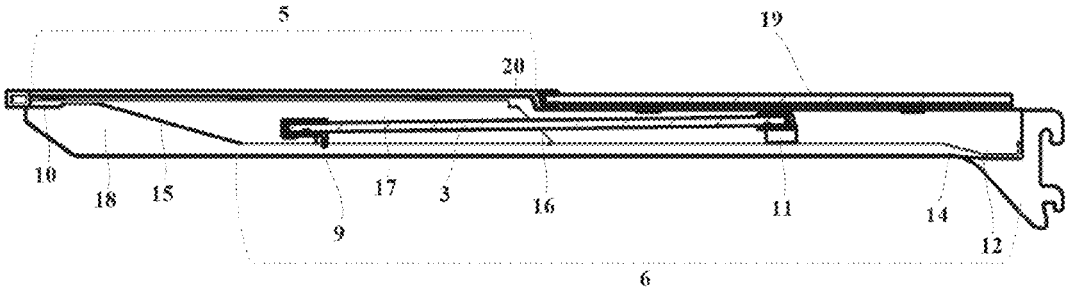
FIG. 6 is a cross-sectional view of the shelf tray assembly according to an embodiment of the invention, where the first partition is located between a first position and a second position.
Figure 7:
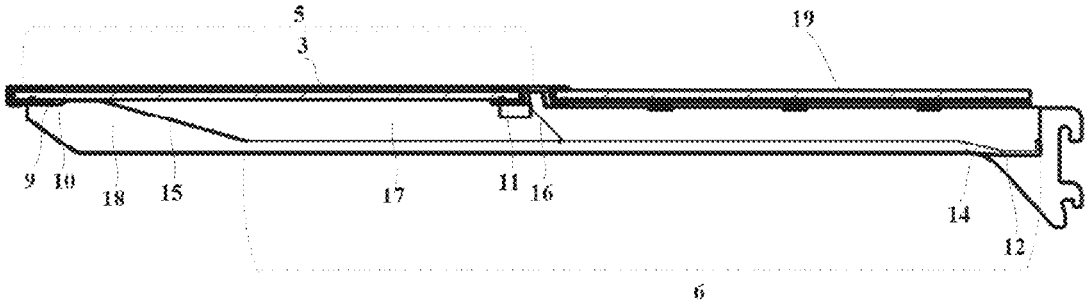
FIG. 7 is a cross-sectional view of a shelf tray assembly according to an embodiment of the invention, where the first partition is located at a first position.

Hereinafter, the principle of the invention is exemplarily described below with reference to FIGS. 5-9. As shown in FIG. 5, the first partition 3 is located at the second position, the first protrusion 11 and the second protrusion 9 are supported on the second section 6, and the first protrusion 11 is located in the first groove 12 at a rear end of the second section 6. By pulling the first partition 3 forward, the first partition 3 moves forward, and the first protrusion 11 slides out of the first groove 12 along the inclined surface 14. By continuing to pull the first partition 3 forward, the support portion 21 comes into contact with the second guide inclined surface 16, and when the first partition 3 moves forward, the first partition 3 is lifted under the action of the support portion 21 and the second guide inclined surface 16. Because the support portion 21 is in contact with the second guide inclined surface 16, the first protrusion 11 is suspended. When the first partition 3 moves forward, the second protrusion 9 comes into contact with the first guide inclined surface 15. When the first partition 3 moves forward, the first partition 3 is lifted under the action of the second protrusion 9 and the first guide inclined surface 15. By continuing to pull the first partition 3, the second protrusion 9 slides through a part of the first section 5 and then falls into the second groove 10, the support portion 21 slides through the second guide inclined surface 16 and falls into the third groove 20, and the first protrusion 11 continues to be in a suspended state. Because of the cooperation of the second protrusion 9 with the second groove 10, and the third groove 20 with the support portion 21, the first partition 3 is limited and difficult to continue to move forward.

Figure 9:
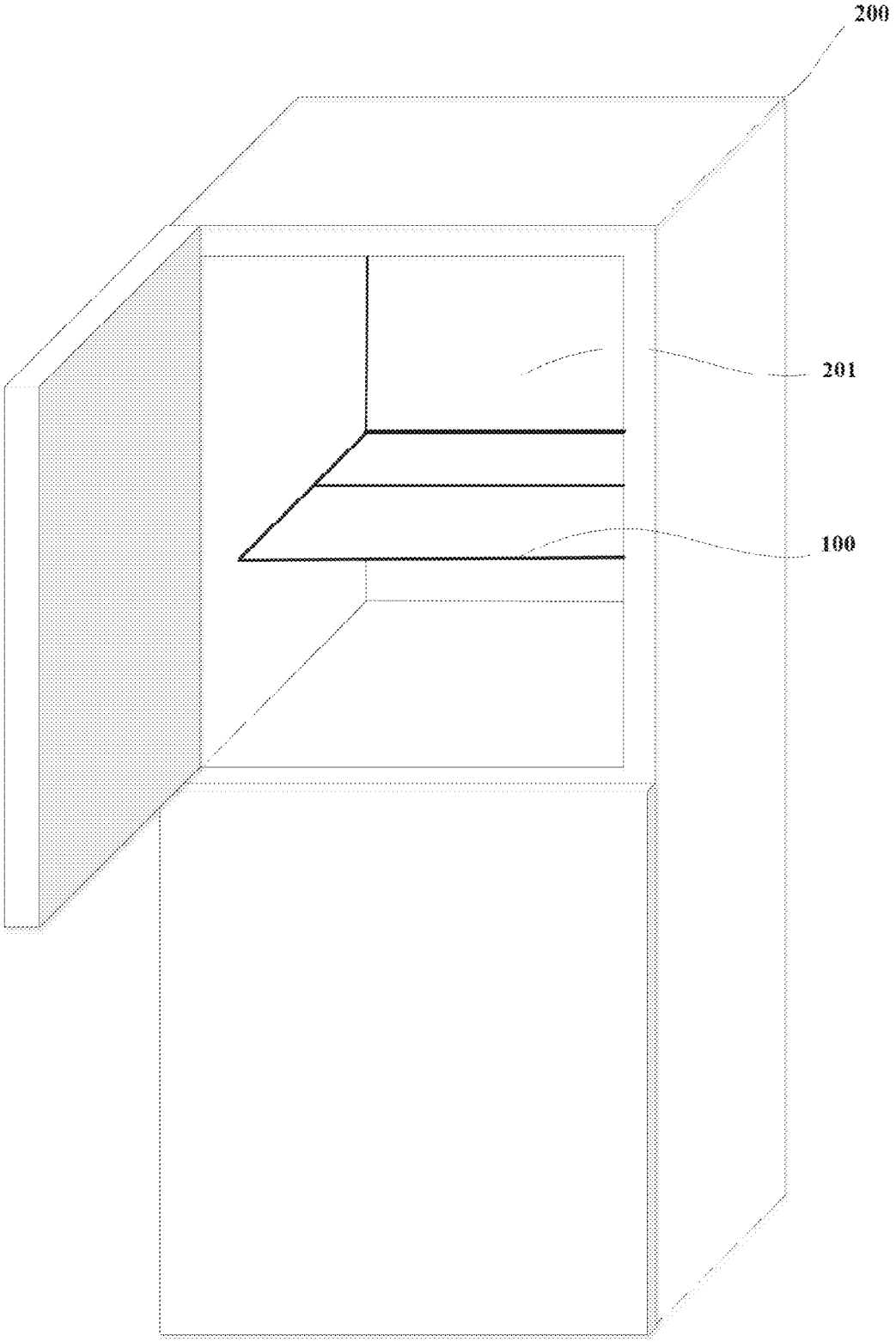
FIG. 9 is a diagrammatic, perspective view of a refrigerator including the shelf tray assembly according to an embodiment of the invention.

The invention further provides a refrigeration appliance 200, as shown in FIG. 9. The refrigeration appliance 200 includes any shelf tray assembly 100 described above. The shelf tray assembly 100 is used in a storage cavity 201 of the refrigeration appliance 200 for dividing the storage cavity 201 into two or more small storage units. A bracket 1 of the shelf tray assembly 100 includes a mounting structure through which the shelf tray assembly 100 can be mounted into the storage cavity 201 of the refrigeration appliance 200.

The refrigeration appliance 200 may be a refrigerator, a wine cabinet, or the like.

The refrigeration appliance 200 provided by the invention can effectively reduce the height difference when the first partition rises or falls, and make the moving process of the first partition become smoother with less friction, so that the user experience can be improved.

Although specific implementations have been described above, these implementations are not intended to limit the scope of the disclosure of the present application, even if only one implementation is described with respect to specific features. The feature example provided in the disclosure of the present application is intended to be illustrative rather than limiting, unless otherwise stated. During specific implementation, according to an actual requirement, in a technically feasible case, the technical features of one or more dependent claims may be combined with the technical features of the independent claims, and the technical features from the corresponding independent claims may be combined in any appropriate manner instead of using just specific combinations listed in the claims.

The various specific implementations described above and shown in the accompanying drawings are merely used for illustrating the present application, but are not all of the present application. Any variation made by a person of ordinary skill in the art to the present application within the scope of the basic technical concept of the present application shall fall within the protection scope of the present application.

The invention claimed is:

1. A shelf tray assembly, comprising:

a bracket having a sliding rail, said sliding rail containing a second section and a first section higher than said second section, there being a first height difference between said first section and said second section;

a partition having a first partition, said first partition configured to reciprocate on said bracket along said sliding rail, and a movement path of said first partition includes a first position and a second position, when said first partition is disposed at the first position, said first partition is at least partially supported on said first section, when said first partition is disposed at the second position, said first partition is at least partially supported on said second section; and a lifting structure configured to lift said first partition, so that a rising height of said first partition moving from the second position to the first position is less than the first height difference, wherein said lifting structure has a first protrusion, said first protrusion is disposed on said first partition and protrudes toward said sliding rail, wherein when said first partition is disposed at the second position, said first protrusion is supported on said second section, wherein when said first partition is disposed at the first position, a lower end of said first protrusion is lower than a height of said first section, wherein when said first partition is disposed at the first position, said first protrusion is suspended so that said lower end of said first protrusion is lower than the height of said first section.

2. The shelf tray assembly according to claim 1, wherein:

said first partition further has a support portion being higher than said first protrusion, said support portion extends toward both sides;

when said first partition is disposed at the first position, said support portion is supported on the first section; and when said first partition is disposed at the second position, said support portion is suspended.

3. The shelf tray assembly according to claim 2, wherein:

said lifting structure further has a second protrusion disposed at a front end of said first partition and a second groove formed therein at a front end of said first section, said second protrusion protrudes toward said sliding rail; and when said first partition is disposed at the first position, said second protrusion is disposed at said second groove.

4. The shelf tray assembly according to claim 3, wherein said lifting structure has a third groove formed therein and disposed at a rear end of said first section, and when said first partition is disposed at said first position, said support portion is disposed in said third groove.

5. The shelf tray assembly according to claim 4, wherein:

said second section has a first groove formed therein and disposed at a rear end of said second section, said first groove cooperates with said first protrusion to limit a backward movement of said first partition; and/or said second groove cooperates with said second protrusion to limit forward movement of said first partition; and/or said third groove cooperates with said support portion to limit a forward movement of said first partition.

6. The shelf tray assembly according to claim 5, further comprising an inclined surface, wherein said first groove and said sliding rail are connected by said inclined surface.

7. The shelf tray assembly according to claim 2, wherein said sliding rail further includes a guide inclined surface inclined downward from front to rear, and said guide inclined surface connects said first section and said second section.

8. The shelf tray assembly according to claim 7, wherein:

said guide inclined surface has a first guide inclined surface and a second guide inclined surface, said first guide inclined surface is disposed in front of said second guide inclined surface; and said first guide inclined surface is configured for said second protrusion to slide, and said second guide inclined surface is configured for said support portion to slide.

9. The shelf tray assembly according to claim 8, wherein a slope of said first guide inclined surface is less than that of said second guide inclined surface.

10. The shelf tray assembly according to claim 8, wherein:

said bracket having a side wall and a first boss disposed at a front end of said bracket and protruding inward relative to said side wall of said bracket; and said first boss having a rearward-facing side wall surface being inclined downward from front to rear to form at least a part of said second guide inclined surface.

11. The shelf tray assembly according to claim 10, wherein said bracket having a second boss located at a front end of said first boss and protruding inward relative to said first boss, wherein said second boss having a rearward-facing side wall surface inclining downward from front to rear to form at least a part of said first guide inclined surface.

12. The shelf tray assembly according to claim 1, wherein:

said partition further having a second partition, said second partition is disposed at a rear end of said bracket;

when said first partition is disposed at the first position, said first partition is disposed in front of said second partition; and when said first partition is disposed at the second position, said first partition is disposed below said second partition.

13. A refrigeration appliance, comprising:

a storage cavity having a cavity wall; and said shelf tray assembly according to claim 1, wherein said bracket is connected to said cavity wall of said storage cavity to mount said shelf tray assembly to said storage cavity.

* * * * *